US005698970A

United States Patent [19]

Stanojevic

[11] Patent Number: 5,698,970

[45] Date of Patent: Dec. 16, 1997

[54] SWITCHING SHUNT REGULATOR

[75] Inventor: Silvo Stanojevic, Milpitas, Calif.

[73] Assignee: Exar Corporation, Fremont, Calif.

[21] Appl. No.: 631,901

[22] Filed: Apr. 16, 1996

[51] Int. Cl.[6] ..... G05F 1/613

[52] U.S. Cl. ..... 323/223; 323/282; 323/315

[58] Field of Search ..... 323/223, 224, 323/220, 236, 324, 325, 284, 282, 285, 315

[56] References Cited

U.S. PATENT DOCUMENTS

| | | | |
|---|---|---|---|
| 4,710,699 | 12/1987 | Miyamoto | 323/324 |
| 4,745,300 | 5/1988 | Kammerer et al. | 307/112 |
| 5,302,889 | 4/1994 | Marsh | 323/284 |
| 5,552,644 | 9/1996 | Calder et al. | 307/116 |

*Primary Examiner*—Adolf Berhane

*Attorney, Agent, or Firm*—Townsend and Townsend and Crew LLP

[57] ABSTRACT

A shunting regulator which is configured to act as a switch. The regulator includes an enabling input which can be used to turn it on and off when the switch is desired to be closed and opened. Preferably, the regulator includes a switching transistor connected to the enabling input which activates a drive transistor circuit. A current mirror is connected to the regulator output and provides current to both the drive circuit and a differential amplifier used for error correction. The two transistors of the differential amplifier are connected to first and second resistor divider circuits to provide the appropriate reference voltages. The invention thus provides what is essentially an adaptive current drive with a high dynamic range.

12 Claims, 2 Drawing Sheets

SWITCHING SHUNT REGULATOR

BACKGROUND OF THE INVENTION

The present invention relates to two-wire switches, and in particular to use of a voltage regulator for a two-wire switch.

Voltage regulators are typically used to provide a closely regulated output voltage from a supply voltage which can vary. It is important for the regulator to have a good power supply rejection ratio (PSRR), so that the regulator output is insulated from variations in the supply voltage. Typically, such a regulator is always active when a voltage supply is present.

In many applications, a two-wire switch is included in series with a load to activate the load. For instance, the switch may include a proximity sensor to determine when an object is close by to activate the switch. Such an application typically requires obtaining current from the loop through the load at all times so that the proximity sensor can work. In addition, a switch must be included to provide open and close conditions, while at the same time allowing enough current to power the circuitry in all states.

SUMMARY OF THE INVENTION

The present invention provides a shunting regulator which is configured to act as a switch. The regulator includes an enabling input which can be used to turn it on and off when the switch is desired to be closed and opened.

Preferably, the regulator includes a switching transistor connected to the enabling input which activates a drive transistor circuit. A current mirror is connected to the regulator output and provides current to both the drive circuit and a differential amplifier used for error correction. The two transistors of the differential amplifier are connected to first and second resistor divider circuits to provide the appropriate reference voltages.

The invention thus provides what is essentially an adaptive current drive with a high dynamic range, which can respond to the largely varying voltages present at the regulator output when the load is switched on and off. The response can be very fast, giving a high switching speed, using the input switching transistor and the drive transistor circuitry.

The invention provides a shunting regulator which thus acts as a switch with a small voltage drop (i.e., 2.5 volts) across the switch in the closed state, and exhibits very low quiescent current when the regulator is switched off to simulate an open switch state. The shunt regulator provides the switch action by being disabled in the off state and enabled in the on state. In the disabled state, the entire shunt regulator circuitry conducts no current. In the on state, the shunt regulator provides base drive current to a PNP transistor connected to the load. The PNP transistor conducts the load current and shunts it to ground. The shunt regulator in conjunction with the (preferably external) PNP shunt transistor regulates the voltage connected to the load (VCC) to 300 mV above a reference voltage (VREF) provided by a regulator which provides power to the circuitry in an on state. In the off state, the shunt regulator is disabled, thus the load pulls the VCC voltage up to the supply voltage on the other side of the load.

The present invention also incorporates a number of features to protect against a reverse voltage. All the transistors connected to VCC are PNP transistors. Resistors connected to VCC are P-type resistors in a silicon substrate, enclosed in an N-type tub of silicon. The N tub is biased with a bias current to prevent conduction between the tub and the substrate under the reverse voltage conditions.

The present invention also provides a shutdown input (SHTD) which overrides the input activating signal in the event of certain faults, such as a short circuit.

For a further understanding of the nature and advantages of the invention, reference should be made to the following description taken in conjunction with the accompanying drawings.

DETAILED DESCRIPTION OF THE PREFERRED EMBODIMENTS

Figure 1:
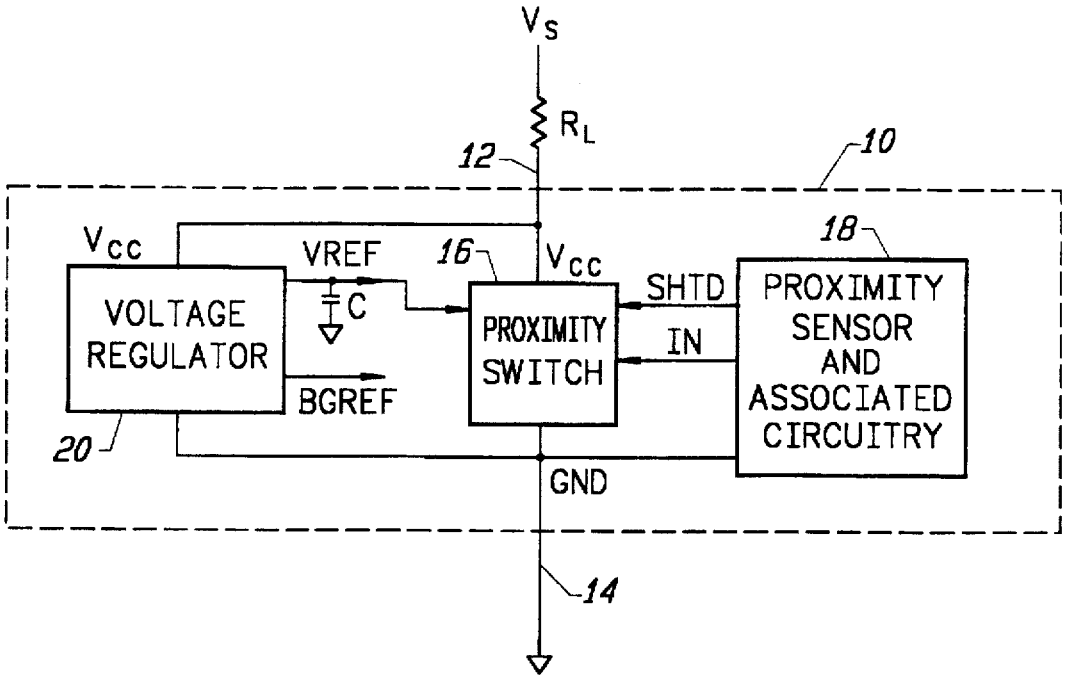
FIG. 1 is a block diagram of one embodiment of a proximity switch circuit incorporating the present invention.

FIG. 1 is a block diagram of one environment into which the present invention can be incorporated. The voltage supply, Vs, is connected to a load, RL. One lead to the load, 12, is connected to the proximity switch 16 of the present invention, while the other lead is a ground lead 14.

An integrated circuit 10 holds the circuits of the present invention. A proximity sensor and associated circuitry 18 detects the proximity of an activating object, and provides an activating signal, IN, to the proximity switch 16. The proximity switch and proximity sensor are powered by a separate voltage regulator 20, which provides a reference voltage VREF.

The proximity sensor circuitry can also provide a shutdown signal SHTD to the proximity switch. In one embodiment, this shutdown signal is an OR function of a short circuit detection signal, a low voltage detection signal, and a current limit signal.

Figure 2:
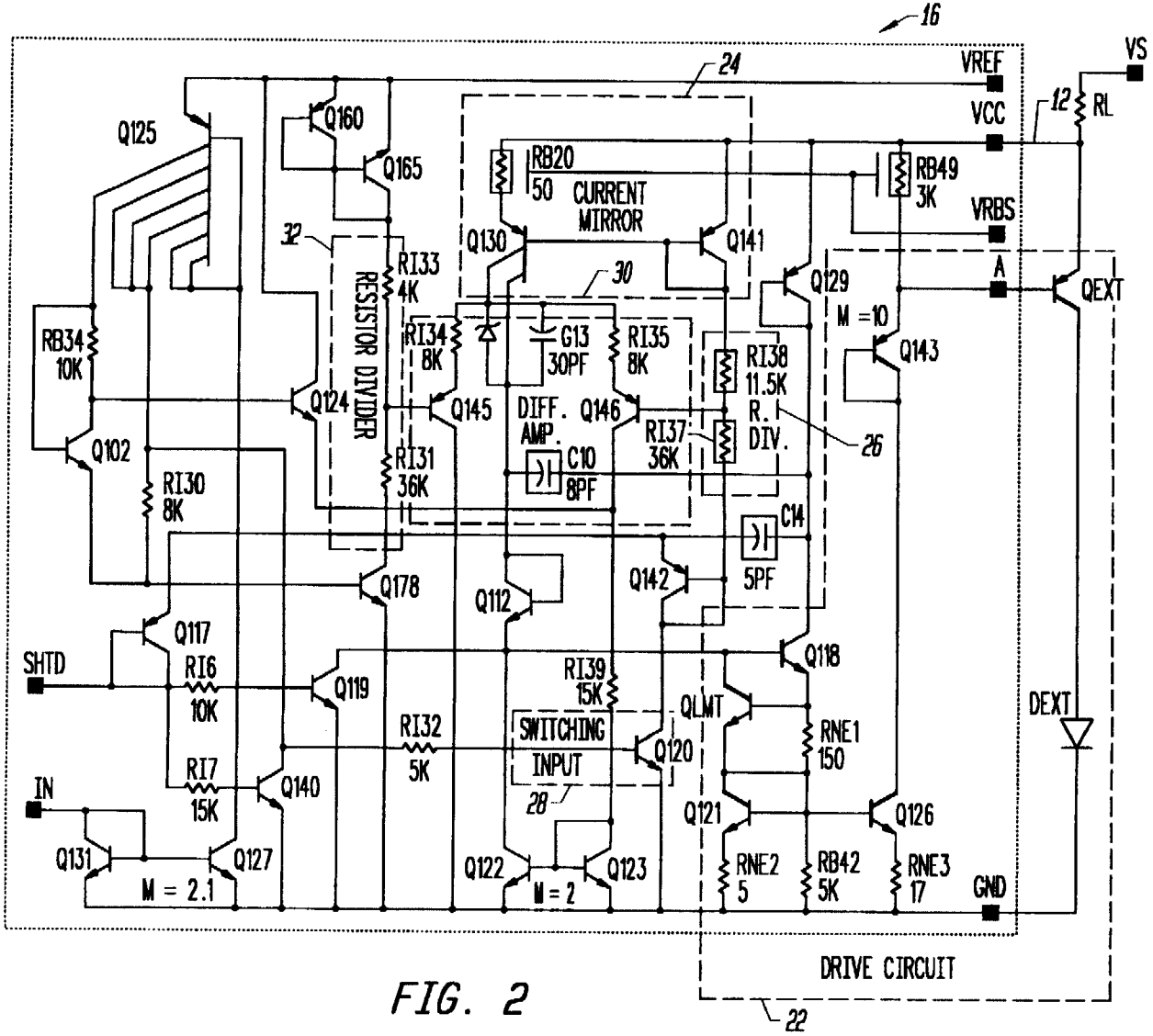
FIG. 2 is a circuit diagram of a preferred embodiment of a shunting regulator switch according to the present invention.

FIG. 2 is a circuit diagram of a preferred embodiment of proximity switch 16 according to the present invention. The proximity switch is a shunting regulator with an enabling input added, and modified to act as a two-lead switch. The regulator output is VCC on line 12, connected to the load and Vs. An external PNP transistor QEXT is added between the load and ground. This external transistor is driven by a drive circuit which consists of a reverse voltage protection diode Q143, a drive transistor Q126 and another drive transistor Q118, and associated other circuitry. The drive circuit 22 is driven through the base of transistor Q118 by connection through a diode-connected transistor Q112 from one leg of a current mirror 24, transistor Q130. This current is activated through the other leg, transistor Q141, by a connection through a resistor divider 26 to a switching input 28, consisting of a transistor Q120 which activates the regulator. Q120 is driven by a current mirror transistor Q125, which is in turn activated by the input signal through a transistor Q127.

When the regulator is not switched on, transistor QEXT is off, and the voltage at VCC will be approximately the same voltage as Vs since no current flows through QEXT or the switching regulator 16 (some current will flow through voltage regulator 20 of FIG. 1). Thus, if Vs is at 55 volts, VCC will be at approximately 55 volts. When the regulator is switched on to make the switch close, QEXT is activated, drawing current through RL, and dropping the voltage from 55 volts to approximately 2.5 volts rapidly. A differential amplifier 30 in the center of FIG. 2 acts as an error correction circuit to adjust the current through the legs of current mirror 24 in response to voltage settings determined by a first resistor divider 32 connected to transistor Q145, and a second resistor divider 26 connected to transistor Q146. This circuitry thus acts as an adaptive current drive with a high dynamic range which can handle voltages from 55 volts to 2.5 volts, for instance.

The input voltage on the IN line can be overridden by a shutdown voltage on line SHTD, which activates a transistor Q119, turning off drive transistor Q118.

The switching shunt regulator described in this disclosure requires a reference voltage, a pair of complementary input turn on/off 5 μA current sources, an external PNP transistor, a load and a supply voltage for proper operation. The fault conditions such as short circuit, under-voltage and current limit are ORd at the SHTD input to provide independent shutdown during any fault condition. In the off state the SHTD input is enabled to prevent the output stage from turning on due to leakage currents and switching transients. In the on state the SHTD input is disabled and the IN input is enabled.

In the proximity sensor the reference voltage VREF is set to 2.20 V. In the on state, the IN input is injected with a 5 μA current source causing Q131, Q127 and Q125 to turn on. Q125 provides base drive to Q178 and Q120. The Q178 transistor sets up a reference voltage for the error amp via a RI31/RI33 resistor divider and a Q160 diode. Transistor Q120 provides base drive to transistor Q118 and tail current to the error amp via the Q141/Q130 current mirror. The Q118 emitter drives the Q121/Q126 current mirror. The Q126 collector provides base drive to the external PNP transistor. The external PNP transistor drives the load, pulling the VCC voltage toward ground. The voltage at the inverting input of the error amp, which is the base of the Q146 transistor, is controlled by the resistive divider RI37/RI38 and the Q141 diode.

Thus, as the VCC voltage approaches the VREF voltage, the base voltage of Q146 approaches the base voltage of the Q145 transistor. As the two base voltages approach the same level, the Q146 transistor starts to conduct current. The Q146 collector current is mirrored and multiplied by two via the Q123/Q122 current mirror. The Q122 collector current steals base drive from the Q118 transistor reducing the base drive to the external PNP transistor.

At the point where the base voltages of Q145 and Q146 are almost equal, the Q122 collector current is almost equal to the Q130 collector current, leaving just enough base drive for Q118 to maintain the required load current to keep the closed loop in equilibrium. In equilibrium, the VCC voltage is regulated at 300 mV above the VREF voltage. 300 mV is obtained by the resistor ratio RI38/RI33 multiplied by the voltage across resistor RI33.

The VCC voltage maintains good temperature tracking due to the VBE cancellation of the Q160 and Q141 diodes. The error amp is internally compensated, eliminating the need for an external capacitor. The main compensation is accomplished with the C10 8 pF capacitor. Additional compensation for very light loads is provided between the Q112 diode and the error amp tail current source Q130 collector.

The light load compensation is provided with a 30 pF capacitor which was realized with a MOS capacitor in parallel with the base-emitter junction capacitance. Q124 and resistor RI39 were also added to prevent low frequency oscillation (motor boating) under light loads. Emitter resistors RI34 and RI35 are also used for stability enhancement. RI34 and RI35 resistors broadband the error amp. The Q102 transistor and the RB24 resistor provide a voltage reference for the Q124 base. Resistors RI30 and RI32 are used to distribute base drive for Q178 and Q120 evenly. Resistors RI6 and RI7 provide for base current distribution for the Q140 and Q119 transistors.

The Q165 diode clamps the resistor RI33 voltage to 1 VBE above the VREF voltage in the off state. This gives the reference voltage at the Q145 base enough time to settle before the Q146 base comes to its equilibrium at the turn on transition. Without the Q112 diode, the Q130 collector connected to RI34 and RI35 saturates, reducing the current available in the Q122 collector to a point where the error amp can find a second stable state, which forces the VCC voltage below its design value to the level where Q118 becomes saturated. By adding the Q112 diode, the Q118 base drive is starved for VCC voltages below 3 VBE+VSAT. Hence, Q118 can never saturate and the VCC voltage is always guaranteed to regulate at its design value.

Because VCC is required to withstand reverse voltage, resistors RB20 and RB49, connected to VCC, use an isolated resistor tub biasing to prevent the resistor from becoming a forward biased diode to the substrate when in reverse voltage mode. Node VRBS provides bias voltage for the resistor tub, which can be implemented with a low value PNP current source connected to VCC. Diode connected PNP transistors Q129 and Q143 provide reverse voltage protection to the Q118 and Q126 NPN transistors respectively.

Resistor RNE1 and transistor QLMT are used to provide current limiting for the Q118 transistor to prevent it from going into thermal runaway during a short circuit condition. Resistors RNE3 and RNE2 are used to lower the current gain of the Q121/Q126 current mirror at high current levels. In this case, resistor RNE3 also protects the Q126 transistor from thermal runaway during the short circuit condition. For foolproof short circuit protection, once a short circuit is detected a shutdown signal can be applied on the SHTD node, which shuts off the drive to the output stage by shunting the Q118 base to ground via the Q119 transistor and by turning off the Q120 transistor, which removes bias current to the error amp.

In the intended application, the shunt regulator acts as a switch. Hence the C10 capacitor and the Q118 collector base capacitance see the full VCC voltage transition. Both capacitors dump charge into the Q118 base during a positive VCC transition (turn off). If the charge is not shunted to ground, the Q118 transistor would turn off very slowly. The Q119 collector shunts some current to ground, but it is not enough. To assure that Q118 turns off fast, capacitor C14 is provided, which dumps charge into the Q119 base during a positive VCC transition. The charge injected from the C14 capacitor is then beta multiplied via the Q119 and Q140 transistors, which assures a fast turn off of the Q118 transistor.

The application requires low quiescent current in both states. This forces error amp bias currents to be set at very low currents. However, a low bias current implies a slow switching speed, which eliminates a low value current source. This design uses resistors RI37 and RI38 to setup bias current and to provide voltage gain in the feedback loop that sets up the VCC voltage level in the on state. The series resistor string is driven with the Q120 transistor, which acts as a switch. Hence, the bias current will depend on the VCC voltage. In the off state, VCC sits near the supply voltage and when the switch is turned on bias current becomes limited by the VCC voltage and the series resistance of RI38 and RI37.

At this turn on switching point, the base drive available to Q118 is very high compared to its equilibrium level of 20 μA. To put it in perspective, the bias current available at 55 V is 30 times the value at 2.5 V.

Note that the Q130 transistor has a 50Ω degeneration resistor in its emitter which limits its emitter current to 450 μA at 55 V supply voltage. The resistors give us two critical advantages over the constant current source: constant switching speed and low quiescent current in the on state. The switching speed is limited by the RC time constant, making it independent of the supply voltage.

As will be understood by those with skill in the art, the present invention may be embodied in other specific forms without departing from the spirit or essential characteristics thereof. For example, differential amplifier 30 could be constructed with NPN transistors, rather than PNP transistors. Accordingly, the foregoing description is intended to be illustrative of the invention, but not limiting, with the scope of the invention being set forth in the following claims.

What is claimed is:

1. A two lead switch for driving an external load, comprising:

a shunting regulator having a regulator output as a first lead of said switch coupled to said external load, a ground connection as a second lead of said switch; and an enabling input of said shunting regulator for turning said regulator on and off to provide open and close conditions of said switch;

a switching transistor having a base activated by said input;

at least one drive transistor having a base coupled to be driven when said switching transistor is turned on, and an output for driving current through said external load;

a current mirror coupled to said regulator output;

a first resistor divider coupled to a first leg of said current mirror and to a lead of said switching transistor; and said base of said drive transistor being coupled to a second leg of said current mirror.

2. The switch of claim 1 further comprising:

a differential amplifier, having first and second transistors, coupled to said second leg of said current mirror; and a second resistor divider circuit coupled to a reference voltage and to a base of said first transistor in said differential amplifier, said second transistor of said differential amplifier having a base coupled to said first resistor divider.

3. The switch of claim 2 further comprising:

a shut-off input transistor coupled to said base of said drive transistor.

4. The switch of claim 2 wherein said first leg of said current mirror comprises a PNP transistor having a first collector connected to said differential amplifier, and a second collector coupled to said base of said drive transistor, and further comprising a capacitor connected between said second collector and a collector of said drive transistor, said drive transistor being an NPN transistor.

5. The switch of claim 4 further comprising:

a second capacitor, larger than said first capacitor, connected between said first and second collectors of said PNP transistor.

6. The switch of claim 2 further comprising:

a second NPN drive transisitor having a base coupled to an emitter of said drive transistor;

a blocking diode having an anode coupled to a collector of said second NPN drive transistor; and an external PNP transistor having a base coupled to a cathode of said blocking diode and an emitter coupled to said external load and said regulator output.

7. The switch of claim 1 further comprising:

a second NPN drive transisitor having a base coupled to an emitter of said first drive transistor;

a blocking diode having an anode coupled to a collector of said second NPN drive transistor; and an external PNP transistor having a base coupled to a cathode of said blocking diode and an emitter coupled to said external load and said regulator output.

8. A two lead switch for driving an external load, comprising:

an enabling input;

a switching transistor having a base activated by said input;

a drive transistor circuit having a first drive transistor with a base coupled to be driven when said switching transistor is turned on, and an output of said drive transistor circuit connected to drive current through said external load;

a current mirror coupled to a regulator output;

a first resistor divider coupled to a first leg of said current mirror and to a lead of said switching transistor;

said base of said first drive transistor being coupled to a second leg of said current mirror;

a differential amplifier, having first and second transistors, coupled to said second leg of said current mirror; and a second resistor divider circuit coupled to a reference voltage and to a base of said first transistor in said differential amplifier, said second transistor of said differential amplifier having a base coupled to said first resistor divider.

9. The switch of claim 8 further comprising:

a shut-off input transistor coupled to said base of said first drive transistor.

10. The switch of claim 8 wherein all transistors connected to said regulator output are PNP transistors to provide reverse voltage protection.

11. The switch of claim 8 wherein said first leg of said current mirror comprises a PNP transistor having a first collector connected to said differential amplifier, and a second collector coupled to said base of said drive transistor, and further comprising a capacitor connected between said second collector and a collector of said drive transistor, said drive transistor being an NPN transistor.

12. The switch of claim 11 further comprising:

a second capacitor, larger than said first capacitor, connected between said first and second collectors of said PNP transistor.

* * * * *